US005878732A

United States Patent [19]

Engl et al.

[11] Patent Number: 5,878,732

[45] Date of Patent: Mar. 9, 1999

[54] METHOD OF DETERMINING THE MASS OF FUEL TO BE INTRODUCED INTO THE SUCTION PIPE INTO THE CYLINDER OF AN INTERNAL COMBUSTION ENGINE

[75] Inventors: Maximilian Engl, Regensburg; Willibald Schuerz, Aufhausen; Johann Froehlich, Landshut, all of Germany

[73] Assignee: Siemens Aktiengesellschaft, Munich, Germany

[21] Appl. No.: 825,496

[22] Filed: Mar. 28, 1997

[30] Foreign Application Priority Data

Mar. 28, 1996 [DE] Germany ..... 196 12 453.0

[51] Int. Cl.[6] ..... F02D 41/30

[52] U.S. Cl. ..... 123/673; 123/478; 123/675; 123/672

[58] Field of Search ..... 123/478, 480, 123/492, 674, 675, 687, 679, 672, 681, 695, 673

[56] References Cited

U.S. PATENT DOCUMENTS 4,719,888 1/1988 Kobayashi et al. ..... 123/440

FOREIGN PATENT DOCUMENTS

3741527Z1 6/1989 Germany .
3248745C2 4/1992 Germany .
89/02524 3/1989 WIPO .

*Primary Examiner*—Tony M. Argenbright
*Assistant Examiner*—Hieu T. Vo
*Attorney, Agent, or Firm*—Herbert L. Lerner; Laurence A. Greenberg

[57] ABSTRACT

A method of determining a mass of fuel to be introduced into a suction pipe or into a cylinder of an internal combustion engine precontrols a basic injection time constituting a basic injection quantity, through a prescription of a lambda set point. The lambda set point is determined by a coordinated calculation through selecting a minimum and a maximum from a multiplicity of different lambda requirements which are derived from operating states of the internal combustion engine. Different priorities are allocated to the various lambda requirements.

7 Claims, 2 Drawing Sheets

METHOD OF DETERMINING THE MASS OF FUEL TO BE INTRODUCED INTO THE SUCTION PIPE INTO THE CYLINDER OF AN INTERNAL COMBUSTION ENGINE

BACKGROUND OF THE INVENTION

Field of the Invention

The invention relates to a method of determining a mass of fuel to be introduced into a suction pipe or into a cylinder of an internal combustion engine, through the prescription of a combustion air ratio in the cylinder.

Air mass-guided motor control systems for internal combustion engines need to know the mass of fresh air flowing into the cylinder, in addition to the rotational speed, for the calculation of the injection time. A basic injection time is stored in a characteristic map as a function of those two variables. In order to take into account the most diverse operating states of the internal combustion engine, such as, for example, starting, warming up, full load, overrun operation, etc., during the calculation of the injection time, various additive and/or multiplicative correction factors act on the basic injection time, with the result that at the end of the correction chain it is no longer known what combustion air ratio is being realized in the cylinder by the driving of the injection valves.

In the case of internal combustion engines, a defined combustion air ratio is intended to be set as a function of the operating point.

SUMMARY OF THE INVENTION

It is accordingly an object of the invention to provide a method of determining a mass of fuel to be introduced into a suction pipe or into a cylinder of an internal combustion engine, which overcomes the hereinafore-mentioned disadvantages of the heretofore-known methods of this general type and with which the injection time and therefore the mass of fuel to be introduced into the suction pipe or into the cylinder can be determined through the prescription of the combustion air ratio.

With the foregoing and other objects in view there is provided, in accordance with the invention, a method of determining a mass of fuel to be introduced into a suction pipe or into a cylinder of an internal combustion engine, which includes prescribing a combustion air ratio on the basis of a prescribed mass of fresh air necessary for combusting an air/fuel mixture in the cylinder, for achieving a desired intended torque of the internal combustion engine, the method which comprises determining a basic injection time as a function of the air mass in the cylinder and a rotational speed of the internal combustion engine; precontrolling the basic injection time by prescribing a lambda set point; determining the lambda set point by a coordinated calculation from a multiplicity of different lambda requirements derived from the most diverse operating states of the internal combustion engine; carrying out the coordinated calculation of the lambda set point by selection of a minimum and a maximum from the different lambda requirements; assigning different priorities to the lambda requirements and in each case forwarding only that lambda requirement having the higher priority for further processing; and subjecting the injection time precontrolled with the lambda set point to further additive and/or multiplicative correction factors, so that any desired corrections of the combustion air ratio in relation to a reference value can be undertaken.

The solution according to the invention has the advantage that, as the result of a lambda coordination through the use of a minimum and maximum selection process, a desired lambda set point can be set in a simple way. Taking into account this lambda set point, the result is a comprehensible basic structure for calculating the injection time and coordination of the various physical effects.

In accordance with another mode of the invention, there is provided a method which comprises defining the reference value as that value at which the internal combustion engine outputs its maximum torque.

In accordance with a further mode of the invention, there is provided a method which comprises determining the basic lambda value as a function of the air mass in the cylinder and the rotational speed of the internal combustion engine, carrying out the correction of the lambda base value to the lambda set point through multiplication by the basic lambda value and through division by the lambda set point, and using a result of the division multiplicatively in a calculation of the injection time.

In accordance with an added mode of the invention, there is provided a method which comprises defining a maximum lambda value which constitutes a lean running limit of the internal combustion engine, is determined by test-bench trials and is learned through an adaptation by a correction factor.

In accordance with an additional mode of the invention, there is provided a method which comprises defining a minimum lambda value stored as a function of a load in a characteristic map.

In accordance with yet another mode of the invention, there is provided a method which comprises defining a minimum lambda value realized through a constant common to all load states of the internal combustion engine.

In accordance with a concomitant mode of the invention, there is provided a method which comprises determining a torque correction factor from a deviation between the lambda set point and the reference lambda value, indicating a deviation with the torque correction factor in relation to a reference torque as a result of an effective lambda shift and correcting a setting of charging with the torque correction factor.

Other features which are considered as characteristic for the invention are set forth in the appended claims.

Although the invention is illustrated and described herein as embodied in a method of determining the mass of fuel to be introduced into the suction pipe or into the cylinder of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
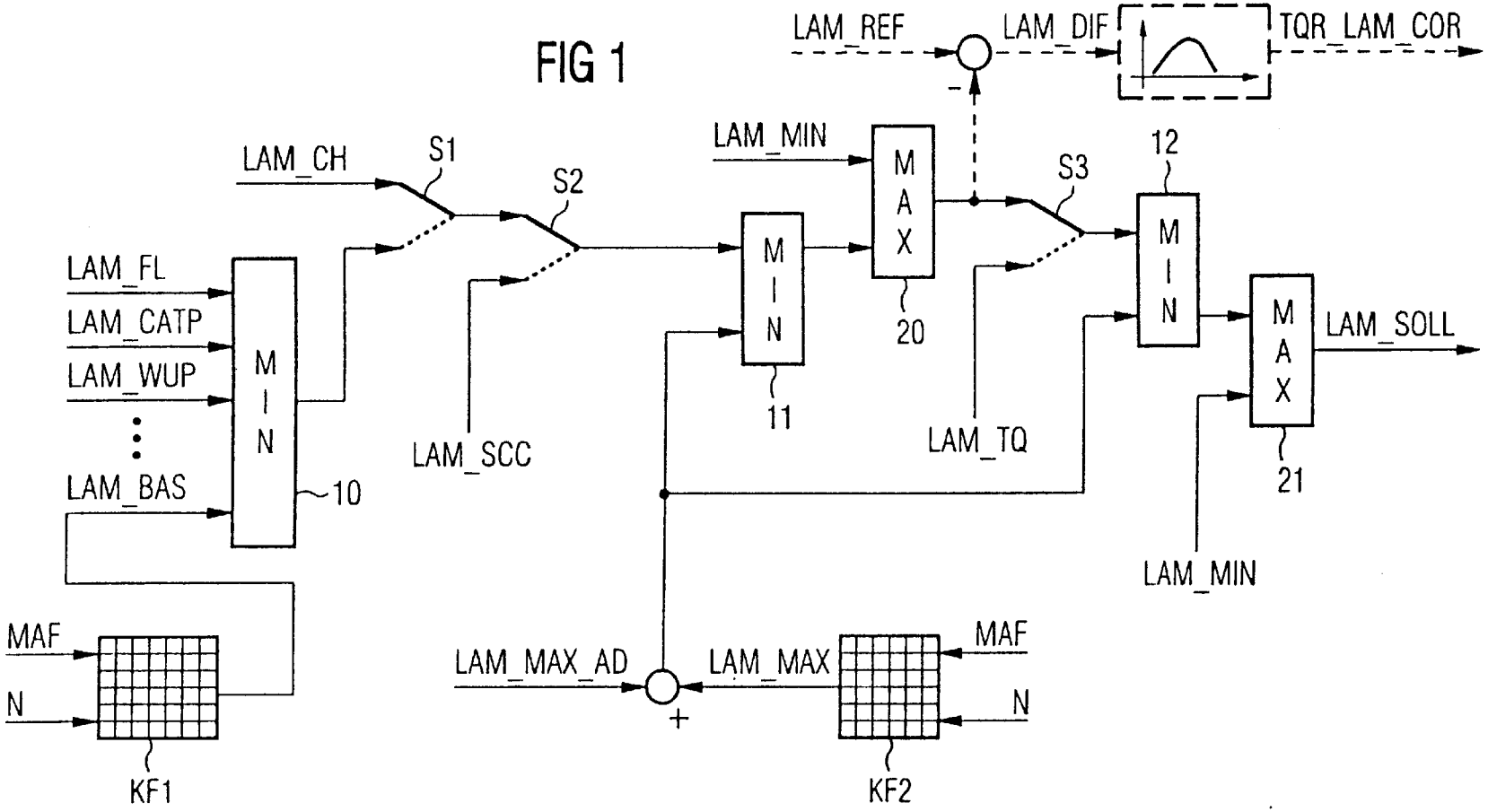
FIG. 1 is a simplified block diagram for determining a lambda set point.

Referring now to the figures of the drawings in detail and first, particularly, to FIG. 1 thereof, there is seen a first minimum selection block 10 which is fed various lambda requirements as input variables, for example a value LAM_FL for a full load operation of an internal combustion engine, a value LAM_CATP for catalytic converter protection, a value LAM_WUP for warming up and a basic lambda value LAM_BAS, which is defined from a characteristic map KF1 as a function of an air mass MAF and a rotational speed N of the internal combustion engine. The air mass MAF in this case can be registered through the use of an air-mass meter in the induction tract or intake tube of the internal combustion engine.

In the selection block 10, a selection of a minimum is made between the input variables. For example, given simultaneous enrichment as a result of full load (lambda requirement LAM_FL) and as a result of catalytic converter protection function (lambda requirement LAM_CATP), only the larger enrichment, that is to say the smaller lambda value of the two requirements, is selected.

An output variable of the selection block 10, which is determined in this way, is passed to one of two inputs of a first switching device S1. A lambda requirement LAM_CH for catalytic converter heating is applied to the other input of this switching device. Depending on whether or not a logic variable for catalytic converter heating is set, either the lambda requirement LAM_CH or the output value from the minimum selection stage 10 is switched through.

The lambda requirement based on the catalytic converter heating function thus has a higher priority than the result of the minimum selection in the stage 10.

The lambda requirement which is forwarded by the switching device S1 is passed to one of two inputs of a second switching device S2. A lambda requirement LAM_SCC for individual cylinder cut-off is applied to the other input of the second switching device. A decision as to which of the two input variables is switched through depends on the state of a logic variable for the individual cylinder cut-off. If this variable is set, that is to say the individual cylinder cut-off function is active, then the lambda requirement LAM_SCC is switched through, otherwise the output value from the switching device S1 is switched through. This means that the lambda requirement based on individual cylinder cut-off is allocated a higher priority than the lambda requirements already mentioned.

The lambda requirement which is present at the output of the switching device S2 is an input variable of a second minimum selection block 11. A further input variable is formed from a value LAM_MAX, which constitutes a maximum lambda value of the internal combustion engine, and an additive correction factor LAM_MAX_AD. The maximum lambda value LAM_MAX is taken from a characteristic map KF2, which is plotted over the air mass MAF and the rotational speed N of the internal combustion engine and has reference points that are determined through the use of test-bench trials. This maximum lambda value LAM_MAX can be learned through an adaptation through the use of the correction factor LAM_MAX_AD. To this end, for example through a measurement of rough running at the crankshaft or through an evaluation of a combustion space pressure, a lean running capability of the individual internal combustion engine can be determined. A correction of the characteristic map value for the lean running capability is then carried out.

A minimum value at the output of the selection block 11 is an input variable for a maximum selection block 20, together with a value LAM_MIN, which is either taken from a characteristic map as a function of load or, in the simplest case, is realized as a constant, for example LAM_MIN=0.7.

The maximum value which is selected in the selection stage 20 is passed to one of two inputs of a third switching device S3. A lambda requirement LAM_TQ, which is, for example, derived from an arbitrary system having torque coordination that converts the driver's wish into a desired torque, is applied to the other input of this switching device. In order to provide the torque coordination, use can be made of an arbitrary torque model which has a desired lambda value as an output variable and which ensures the conversion of the driver's wish into an effective engine torque that is realized in any desired manner by setting interventions on air charging, combustion air ratio and ignition angle.

If a logic variable for the lambda requirement LAM_TQ is set, that is to say if an appropriate intended torque is to be realized on the basis of the driver's wish, and therefore an appropriate lambda value LAM_TQ is to be taken into account, the switching element of the switching device S3 is located in the position drawn in with a dotted line, and the value LAM_TQ is forwarded to a first input of a third minimum selection block 12. Otherwise, the output value of the maximum selection stage 20 is switched through.

The lambda requirement LAM_TQ, which takes a desired intended torque into account, thus has the highest priority of the lambda requirements that were previously present.

The maximum lambda value LAM_MAX which is applied to another input of the minimum selection block 12, has been read out from the characteristic map KF2 and additively corrected through the use of the adaptation factor LAM_MAX_AD.

The minimum value selected in the stage 12 is an input variable for a further maximum selection stage 21, together with the minimum value LAM_MIN, which is read out from a characteristic map or prescribed as a constant. An output variable of the maximum selection stage 21 constitutes a lambda set point LAM_SOLL, which is used for determining an injection time TI in accordance with FIG. 2.

In addition, as is shown in FIG. 1 in a dashed representation, the value selected by the selection stage 20 can be fed to a comparison point shown as a circle, to which a reference value LAM_REF is applied.

A torque correction factor TQR_LAM_COR is determined through a characteristic curve from a difference LAM_DIF between these two values. This factor, which lies in the range from 0 . . . 1, indicates a deviation in relation to the reference torque as the result of an effective lambda shift, and can be used to correct the setting of the charging.

A value which is used as the reference value LAM_REF is, for example, the value at which the internal combustion engine outputs its maximum torque. Typical values therefor lie in a range from 0.88 to 0.92.

Figure 2:
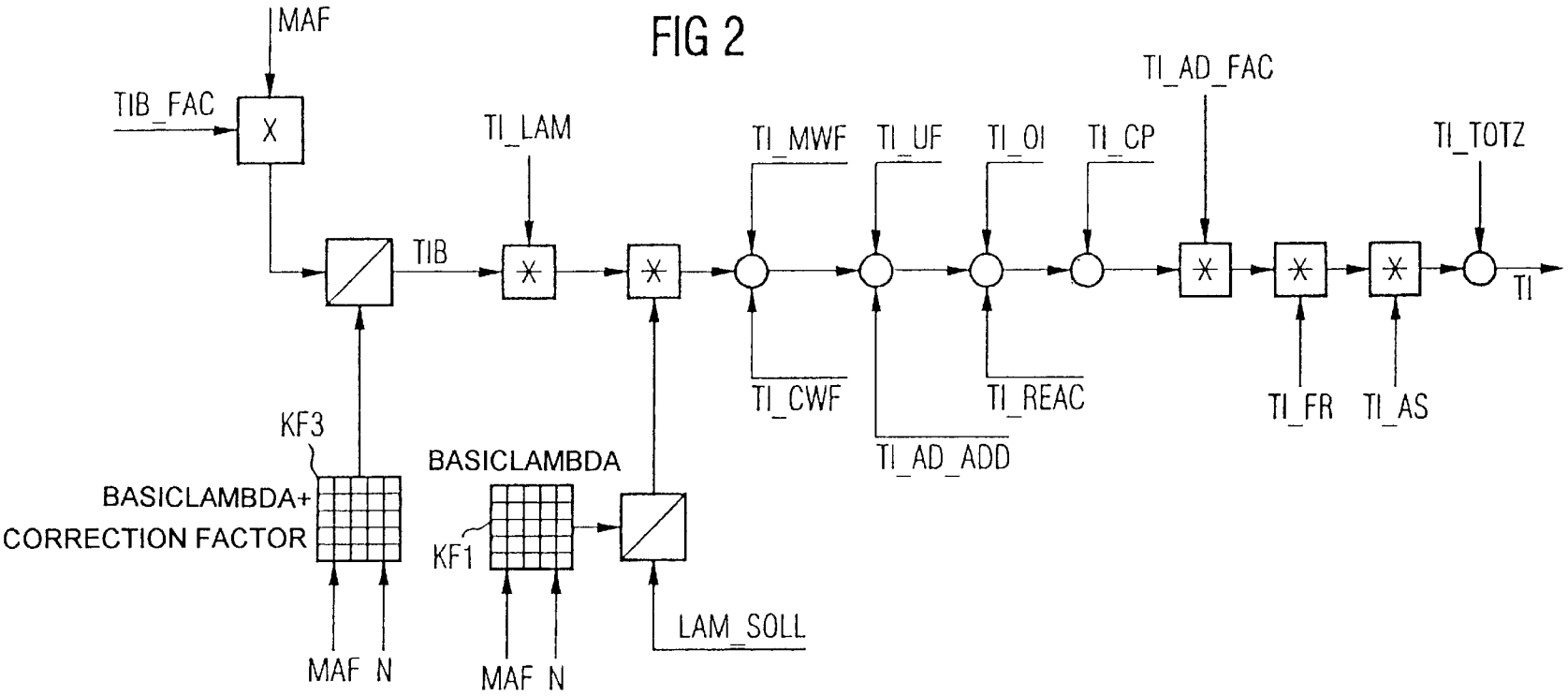
FIG. 2 is a block diagram of basic structure for determining an injection time on the basis of the lambda set point.

FIG. 2 shows a basic structure of the way in which the lambda set point LAM_SOLL that is determined according to the method of FIG. 1, is further processed for the injection time calculation.

A basic injection mass, which is represented by a basic injection time TIB, is calculated from the air mass MAF in a cylinder and a factor TIB_FAC, which depends on a minimum air ratio and an injection valve characteristic curve. In this case, the value for the air mass MAF can be obtained through the use of any desired suction pipe model which supplies an output variable in the form of the air mass flowing into the cylinder, or through the use of the evaluation of a signal obtained from an air-mass meter disposed in the induction tract or intake tube of the internal combustion engine.

A lambda base value is set through a factor with the aid of a characteristic map KF3, depending on the air mass MAF and the rotational speed N of the internal combustion engine. Fine corrections which are dependent on the operating point are also contained in this characteristic map. On the other hand, only the lambda base value without corrections is stored in the characteristic map KF1, that is to say an applied lambda value which depends on the operating point.

The correction of the lambda base value to the lambda set point is carried out through multiplication by the basic lambda value and through division by the lambda set point. As a result, correction functions, such as, for example, weakening the mixture in order to save fuel, enriching the mixture in order to increase the torque or enriching/weakening the mixture in the warming-up phase irrespective of the basic lambda (or of a reference lambda, for example a lambda value at maximum indicated torque) on the lambda plane can be included in the determination of the injection time. The result of this division is used multiplicatively in the calculation of the injection time.

A term TI_LAM denotes a factor which takes into account the multiplicative lambda correction through the lambda control which is superimposed on the precontrol.

Furthermore, during the determination of the injection time, any desired sources of fuel or sinks of fuel can be taken into account through the use of subtractive and/or additive correction variables.

For the case in which the fuel is injected into the suction pipe of the internal combustion engine through the use of one injection valve (single-point injection) or a plurality of injection valves (multipoint injection), a fuel wall film is considered a fuel source (when breaking down the wall film) or a fuel sink (when building up the wall film). During the determination of the injection time TI, this is taken into account through a correction variable TI_MWF. The fuel film which adheres to the cylinder walls is taken into account through a correction variable TI_CWF. In the case of an internal combustion engine having direct injection, in which fuel is injected under high pressure directly into the combustion space, it is necessary to use only the variable TI_CWF as the wall film correction.

Fuel which flows unburnt through the cylinder, for example in the warming-up operating range, constitutes a fuel sink and is taken into account by using a term TI_UF in the calculation of the injection time. A further fuel sink is constituted by so-called oil dilution. Therefore, a term TI_OI takes into account that a part, even if a small part, of the fuel passes into the oil circulation of the internal combustion engine when the engine is cold.

The influence of an additive lambda adaptation is designated by a term TI_AD_ADD, and a reactivation correction is taken into account using a term TI_REAC.

A purging mixture, more or less enriched with fuel, which flows from an active carbon container into the induction pipe when the tank vent valve is open in specific operating states, constitutes a fuel source. This additional enrichment of the combustion mixture with fuel is taken into account additively by using a variable TI_CP.

A multiplicative lambda adaptation, which is intended to compensate for long-term changes of the assignment of the mass of fuel to injection time, is included in the calculation by using a factor TI_AD_FAC.

Effects which lead to a changed pressure ratio across the injection valve, such as, for example, pulsations in the injection valve rail or pressure regulation in the injection valve rail to constant differential pressure with respect to ambient pressure, are corrected by a multiplicative correction (correction factor TI_FR).

A further multiplicative correction element is provided for adjusting the injection time during tuning operations. An injection time correction which is individual to the cylinder is therefore carried out through the application system by using a term TI_AS.

An injection valve dead time correction of the injection time, which is a correction that depends on the voltage supply to the internal combustion engine, is carried out at the end of the correction chain. In order to compensate for these pull-in times of the injection valves, which are times that depend on battery voltage, the injection time is therefore prolonged using the additive variable TI_TOTZ.

At the end of this correction chain, the value tI is available for the injection time, which constitutes the mass of fuel that is to be introduced into the suction pipe or into the cylinder of the internal combustion engine and is determined through the prescription of the combustion air ratio.

We claim:

1. In a method of determining a mass of fuel to be introduced into a suction pipe or into a cylinder of an internal combustion engine, which includes prescribing a combustion air ratio on the basis of a prescribed mass of fresh air necessary for combusting an air/fuel mixture in the cylinder, for achieving a desired intended torque of the internal combustion engine, the improvement which comprises:

determining a basic injection time as a function of the air mass in the cylinder and a rotational speed of the internal combustion engine;

precontrolling the basic injection time by prescribing a lambda set point;

determining the lambda set point by a coordinated calculation from a multiplicity of different lambda requirements derived from the most diverse operating states of the internal combustion engine;

carrying out the coordinated calculation of the lambda set point by selection of a minimum and a maximum from the different lambda requirements;

assigning different priorities to the lambda requirements and in each case forwarding only that lambda requirement having the higher priority for further processing; and subjecting the injection time precontrolled with the lambda set point to further additive and/or multiplicative correction factors, so that any desired corrections of the combustion air ratio in relation to a reference value can be undertaken.

2. The method according to claim 1, which comprises defining the reference value as that value at which the internal combustion engine outputs its maximum torque.

3. The method according to claim 1, which comprises determining the basic lambda value as a function of the air mass in the cylinder and the rotational speed of the internal combustion engine, carrying out the correction of the lambda base value to the lambda set point through multiplication by the basic lambda value and through division by the lambda set point, and using a result of the division multiplicatively in a calculation of the injection time.

4. The method according to claim 1, which comprises defining a maximum lambda value which constitutes a lean running limit of the internal combustion engine, is determined by test-bench trials and is learned through an adaptation by a correction factor.

5. The method according to claim 1, which comprises defining a minimum lambda value stored as a function of a load in a characteristic map.

6. The method according to claim 1, which comprises defining a minimum lambda value realized through a constant common to all load states of the internal combustion engine.

7. The method according to claim 1, which comprises determining a torque correction factor from a deviation between the lambda set point and the reference lambda value, indicating a deviation with the torque correction factor in relation to a reference torque as a result of an effective lambda shift and correcting a setting of charging with the torque correction factor.

* * * * *